US006453672B1

(12) United States Patent
Kendall et al.

(10) Patent No.: US 6,453,672 B1
(45) Date of Patent: Sep. 24, 2002

(54) SEGMENTED SURFACE-STABILIZED GAS BURNER AND METHOD OF USE WITH GAS TURBINES

(75) Inventors: Robert M. Kendall, Sunnyvale; Scott H. Smith, Palo Alto, both of CA (US)

(73) Assignee: Alzeta Corporation, Santa Clara, CA (US)

( * ) Notice: Subject to any disclaimer, the term of this patent is extended or adjusted under 35 U.S.C. 154(b) by 0 days.

(21) Appl. No.: 09/808,063

(22) Filed: Mar. 15, 2001

(51) Int. Cl.[7] ..... F23D 14/12
(52) U.S. Cl. ..... 60/754; 431/328
(58) Field of Search ..... 60/753, 754, 39.11; 431/326, 328, 329

(56) References Cited

U.S. PATENT DOCUMENTS 3,722,866 A * 3/1973 Herzberg ..... 431/329
4,280,329 A * 7/1981 Rackley et al. ..... 431/328
4,311,447 A * 1/1982 Rackley et al. ..... 126/92 AC
4,543,940 A * 10/1985 Krill et al. ..... 126/92 AC
4,597,734 A * 7/1986 McCausland et al. ... 126/92 AC
4,746,287 A * 5/1988 Lannutti ..... 264/256
5,439,372 A * 8/1995 Duret et al. ..... 431/2
6,199,364 B1 * 3/2001 Kendall et al. ..... 60/39.11
6,330,791 B1 * 12/2001 Kendall et al. ..... 431/329

OTHER PUBLICATIONS

American Society of Mechanical Engineers/Paper 99–GT–239 Backside–Cooled Combustor Liner for Lean-Premixed Combustion byKenneth Smith & Anthony Fahme (1999) 5 pages.

* cited by examiner

*Primary Examiner*—Ehud Gartenberg
(74) *Attorney, Agent, or Firm*—Paul W. Garbo

(57) ABSTRACT

A segmented surface-stabilized gas burner features wide modulation of thermal output simply by the independent control of fuel gas flow to each burner segment. The burner also features a porous fiber burner face, preferably having dual porosities, and a metal liner positioned to provide a compact combustion zone adjacent the burner face. The segmented surface-stabilized burner is ideally suited for use with gas turbines not only because of its compactness and broad thermal modulation but also because only the flow of fuel gas to each burner segment requires control while the relative flow of compressed air into the segments of the burner remains unchanged.

19 Claims, 3 Drawing Sheets

SEGMENTED SURFACE-STABILIZED GAS BURNER AND METHOD OF USE WITH GAS TURBINES

BACKGROUND OF THE INVENTION

This invention relates to a broadly modulated radiant gas burner that yields minimal emissions of air-pollutants, especially nitrogen oxides (NOx). More particularly, the burner face of this invention is a porous mat of metal and/or ceramic fibers which is divided into segments that can be individually fired.

Radiant, surface-combustion gas burners are fed fuel gas admixed with enough air to ensure complete combustion of the fuel gas. Because these burners function without secondary air, their modulation of heat output is limited. Yet, there are important uses of surface-combustion gas burners in tight spaces, such as in the casings of gas turbines, where adding spare burners to increase heat delivery is not a practical solution to broad heating modulation.

Assignee's U.S. Pat. No. 6,199,364 to Kendall et al discloses compact surface-stabilized gas burners that are well suited for use with gas turbines. Surface-stabilized gas burners are therein defined as having burner faces with dual porosities so that surface combustion from the lower porosity areas serves to keep the blue flames from the higher porosity areas attached to the burner face when fired at rates of at least about 500,000 BTU/hr/sf (British Thermal Units per hour per square foot) of burner face.

A principal object of this invention is to provide compact surface-stabilized gas burners featuring a broad range of heat delivery.

Another important object is to provide such surface-stabilized gas burners with internal walls that divide each burner into two or more segments that can be individually and independently fired to vary the thermal output, while maintaining the adiabatic flame temperature of the fired segments in a range yielding low emissions.

Still another object is to provide segmented surface-stabilized gas burners that are simple in construction as well as operation.

These and other features and advantages of the invention will be apparent from the description which follows.

SUMMARY OF THE INVENTION

Basically, the segmented surface-stabilized gas burner of this invention which has a combustion surface formed of metal and/or ceramic fibers may have a unitary body with internal partitions to provide independent burner segments, or it may have two or more burner modules that are compactly fitted together.

U.S. Pat. No. 4,543,940 to Krill et al describes a segmented radiant surface burner formed of large cylindrical segments that are bolted together in axial alignment. This arrangement of large burner segments was conceived to fit the peculiar shape of combustion chambers of fire tube boilers. The serial alignment involves sealing between the abutted ends of contiguous burner sections and requires an individual duct to supply fuel gas and air to each burner segment. The complex ducting of fuel gas and air to each burner segment is antithetical to this invention's objective of burner compactness that is essential to burners used with gas turbines.

The combustion surface may be formed of ceramic fibers as taught by U.S. Pat. No. 4,746,287 to Lannutti, of metal fibers as set forth in U.S. Pat. No. 4,597,734 to McCausland, or of mixed metal and ceramic fibers according to U.S. Pat. No. 5,326,631 to Carswell et al. For high surface firing rates, say, at least about 500,000 BTU/hr/sf of burner face, a rigid but porous mat of sintered metal fibers with interspersed bands or areas of perforations is preferred. Such a burner face is shown in FIG. 1 of U.S. Pat. No. 5,439,372 to Duret et al. Still another form of porous metal fiber mat sold by N.V. Acotech S.A. of Zwevegem, Belgium, is a knitted fabric made with a yarn formed of metal fibers. In the rigid porous and perforated burner of Duret et al, radiant surface combustion is interspersed with blue flame combustion from the perforations. Similarly, the yarn of the knitted metal fiber fabric provides radiant surface combustion and the interstices of the knitted fabric naturally provide interspersed spots of increased porosity that yield blue flames.

At the aforesaid high surface firing rates, the flames from the areas of increased porosity produce such intense non-surface radiation that the normal surface radiation from the areas of lower porosity disappears. However, the dual porosities make it possible to maintain surface-stabilized combustion, i.e., surface combustion stabilizing blue flames attached to the burner face. Burner faces with dual porosities are referred to as surface-stabilized burners. With such burners, flaming is so compact that visually a zone of strong infrared radiation appears suspended close to the burner face. It is noteworthy that with at least about 40% excess air, surface-stabilized combustion yields combustion products containing low emissions as little as 2 ppm (parts per million) NOx and not more than 10 ppm CO and UHC (unburned hydrocarbons), combined.

In as much as the segmented burner of this invention is particularly valuable in uses where the combustion zone is spatially limited, it is seldom a flat burner. Cylindrical burner faces and variations thereof, e.g., tapered or conical, are the usual forms of the segmented burner.

The burner segments which fit together may be designed to deliver equal quantities of heat, but it is usually advantageous to have segments of unequal heat delivery capacities. For example, a two-segment burner, can have one segment with 60% and the other segment with 40% of the total heat delivery capacity of the burner. Such unequal segments permit greater heat delivery modulation than if the burner had two equal segments. The same is true of three-segment burners. Three segments of 55%, 35% and 10% of heat delivery capacity permit greater modulation of heat delivery than is possible with three segments of equal heat delivery capacity.

BRIEF DESCRIPTION OF THE DRAWINGS

To facilitate further description and understanding of the invention, reference will be made to the accompanying drawings of which.

DESCRIPTION OF PREFERRED EMBODIMENTS

Figure 1:
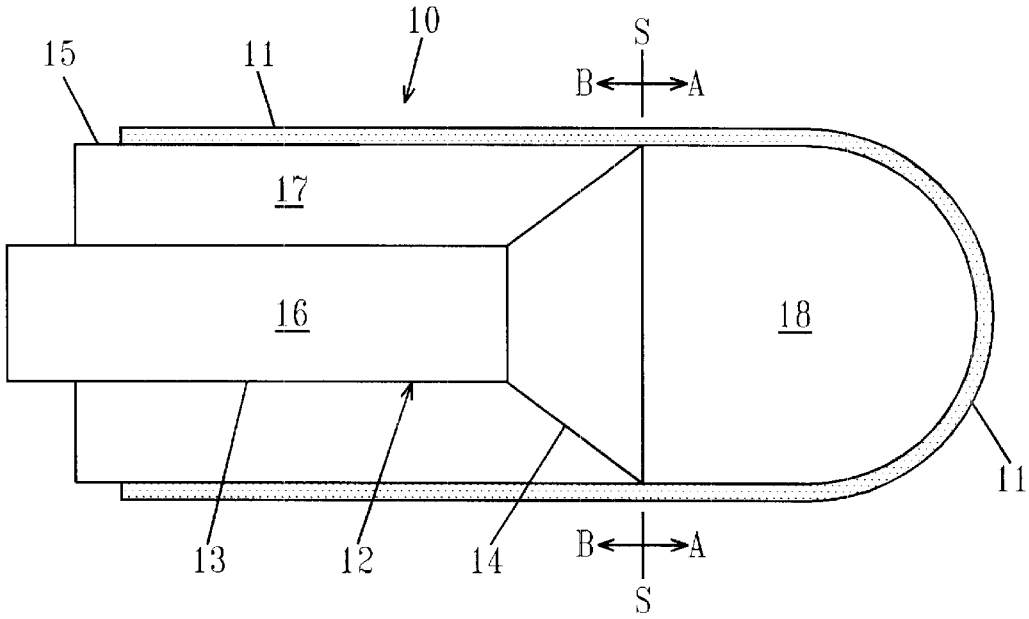
FIG. 1 is a schematic representation of a simple two-segment cylindrical burner shown in axial section.

FIG. 1 schematically depicts a two-segment cylindrical burner 10 having a porous fiber combustion surface 11 which is divided into two separate burning segments by a funnel-like baffle 12. Tube 13 connected to frusto-conical portion 14 of funnel 12 is fitted co-axially in cylinder 15 to create core plenum 16 and annular plenum 17. Core plenum 16 expands beyond tapered baffle 14 into plenum 18 which supplies fuel gas and air to segment A of combustion surface 11. Segment A of surface 11 is the portion to the right of the line where baffle 14 meets an inner support screen (not shown) of fiber surface 11. Porous fiber combustion surface 11 surrounding annular plenum 17 is segment B contiguous to segment A.

It is obvious that fuel gas and air can be supplied to tube 13 for surface combustion on only segment A of porous fiber layer 11. For increased thermal output, fuel gas and air can be introduced via cylinder 15 to annular plenum 17 for combustion on segment B of fiber layer 11. Of course, the reverse order of firing can be carried by feeding fuel gas and air to plenum 17 and feeding fuel gas and air to core plenum 16 when increased heat output is desired.

The simplicity and compactness of burner 10 of FIG. 1 demonstrates that it can be made with a unitary cylindrical body having a hemispherical closed end and a funnel-like baffle inserted through the opposite open end of the cylindrical body. In fact, that is the construction that has been described in relation to FIG. 1. However, if each of lines 13, 14 in FIG. 1, which form funnel 12, are considered as two contiguous metal sheets and segments A, B of fiber layer 11 are not united at circumferential line S, burner 10 becomes one having two telescoped burner modules. The module with plenum 16, 18 has its tube 13 inserted into a central, similar tube of annular plenum 17. The insertion is made from the right end of cylinder 15 that supports segment B of porous fiber layer 11. When tapered wall 14 of plenum 18 is brought into contact with similar tapered wall of annular plenum 17, the insertion is completed and segment A of combustion surface 11 meets segment B to function essentially as if surface 11 had been pressure or vacuum molded or knitted as a continuous porous fiber layer 11 spanning both plenums 17, 18.

Figure 2:
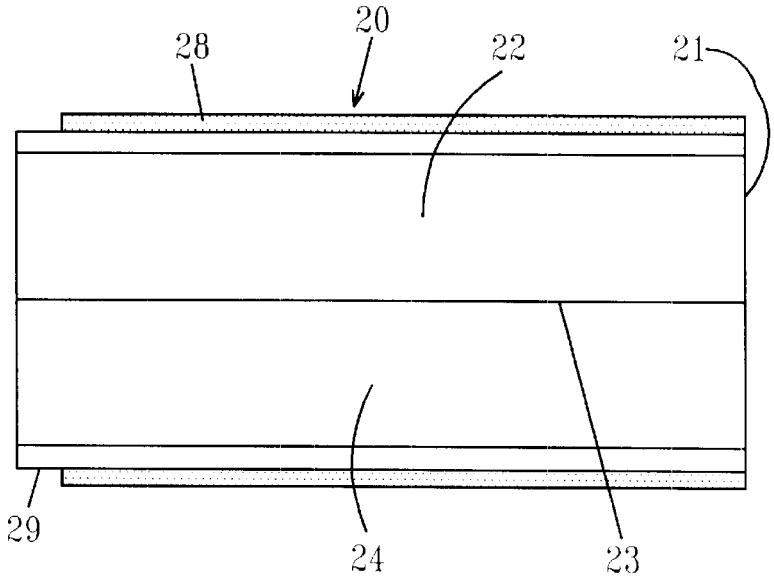
FIG. 2 is a similar representation of a three-segment cylindrical burner shown in axial section.

FIG. 2 shows an axial section of cylindrical burner 20 that is sealed by metal disk 21 at its right end and open at its opposite end.

Figure 3:
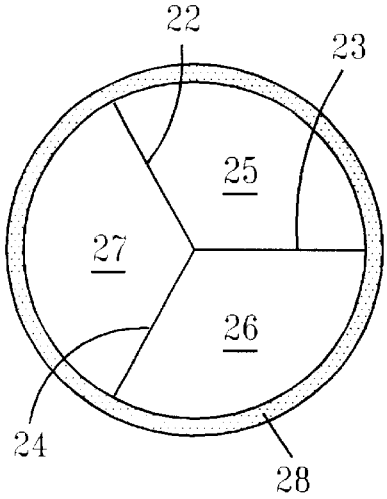
FIG. 3 is a left end view of the burner of FIG. 2.

FIG. 3 is a left end view of burner 20 revealing three radial baffles 22, 23, 24 which form three plenums 25, 26, 27 in burner 20. Plenums 25, 26, 27 feed three equal segments of porous fiber combustion surface 28 on cylinder 29. However, it is usually preferable to make the angles between baffles 22, 23, 24 unequal so that the areas of the three segments of combustion surface 28 are also unequal. Moreover, baffles need not be radial. For example, two baffles at right angles to each other within cylinder 29 can provide three plenums of unequal size. A single baffle that is not a diametrical divider will form two plenums of unequal size in burner 20 with porous fiber layer 28 divided into two segments of unequal areas.

Figure 4:
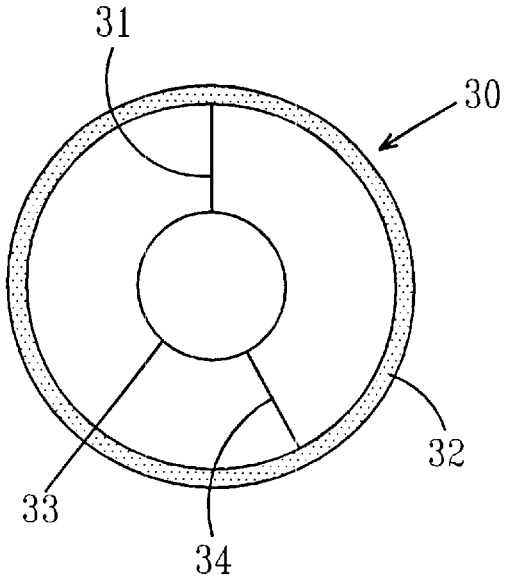
FIG. 4 is a left end view of the burner of FIG. 1 modified to provide three burner segments.

FIG. 4, like FIG. 3, is an open end view of a cylindrical burner 30 that, like burner 10 of FIG. 1, has a funnel-like plenum surrounded by an annular plenum. Burner 30 differs from burner 10 in that the annular plenum is divided into two unequal parts by baffles 31, 32 extending from tube 33 outwardly to the cylindrical screen (not shown) that supports porous fiber layer 34. Thus, baffles 31, 32 have converted the two-segment burner 10 of FIG. 1 into three-segment burner 30.

Figure 5:
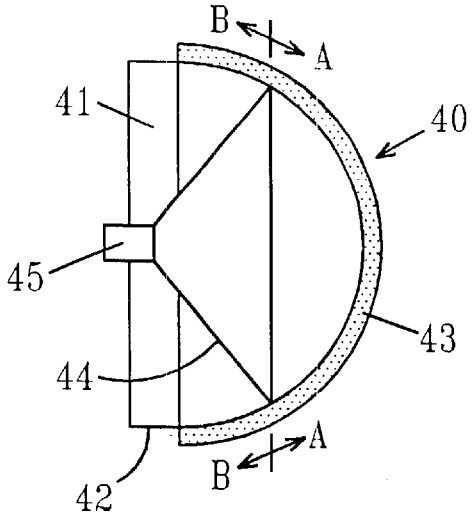
FIG. 5 schematically represents a hemispherical burner having two burner segments.

FIG. 5 is a diametrical sectional view of hemispherical burner 40 that has a pan plenum 41 with inlet opening 42. A hemispherical screen which supports a porous layer 43 of metal and/or ceramic fibers is attached to pan 41. Funnel-like baffle 44 with its tube 45 extending through pan 41 divides combustion surface 43 into two segments, A, B that can be fired separately or together. Fuel gas and air supplied to tube 45 will yield radiant surface combustion on segment A of porous fiber layer 43. When increased heating is desired, fuel gas and air introduced through inlet 42 to pan 41 will combust on segment B of porous fiber layer 43. Of course, combustion can be carried out with only segment B of burner 40. When greater heating is desired, fuel gas and air can be fed to tube 45 for combustion on segment A of porous fiber layer 43.

Figure 6:
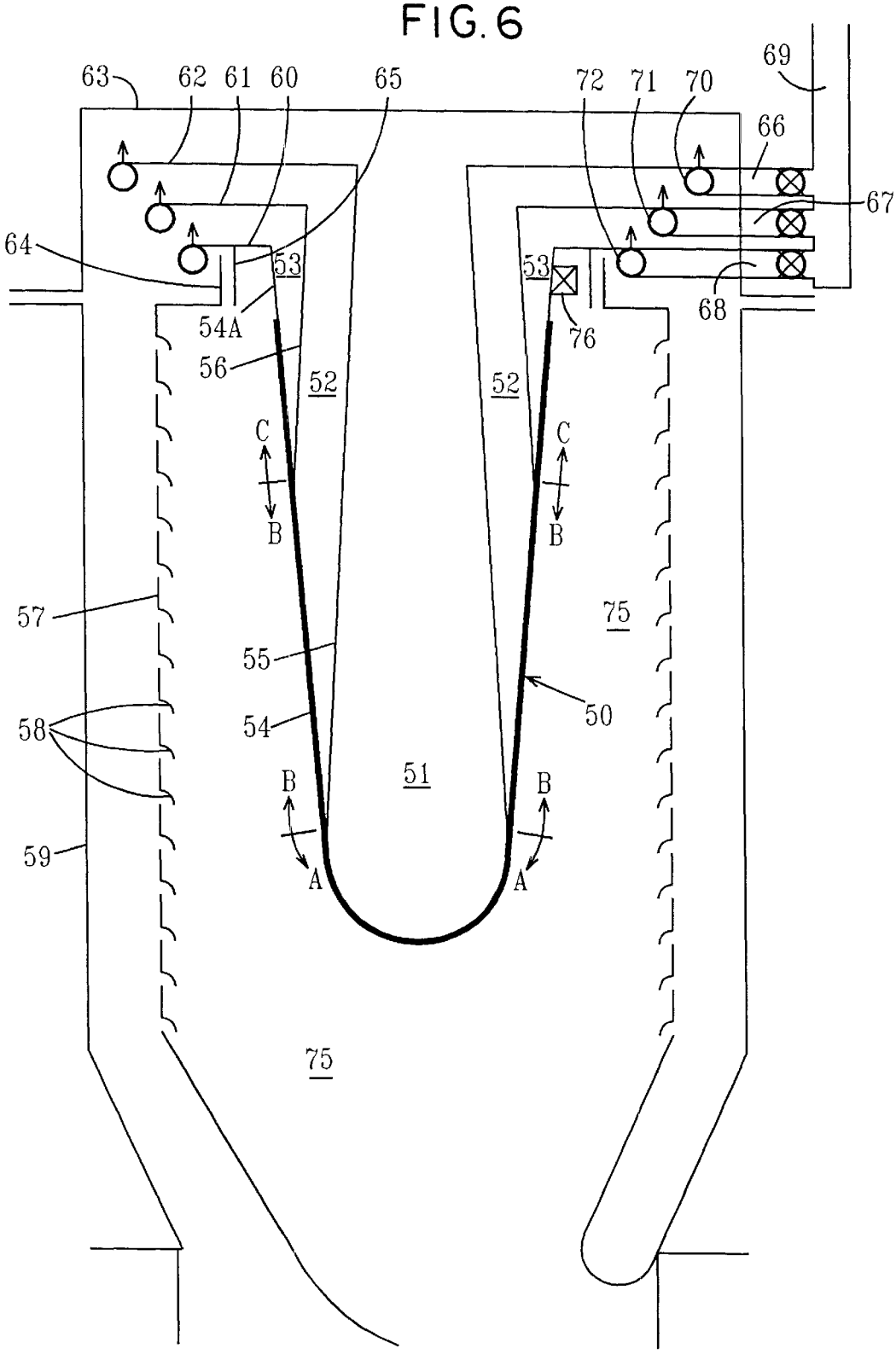
FIG. 6 is a schematic axial section of a three-segment conical burner adapted for use with a gas turbine.

FIG. 6 demonstrates a three-segment burner 50 of the invention adapted for use with a gas turbine. FIG. 6 is presented as an improved (provides greater thermal modulation) burner for replacement of burner 62 in FIG. 6 of assignee's U.S. Pat. No. 6,199,364. Whereas prior burner 62 has a single plenum 63, new burner 50 has three plenums, 51, 52, 53 which supply fuel gas and air to three segments A, B, C of porous combustion surface 54. Tubular baffle 55 separates plenum 51 from plenum 52 which is separated from plenum 53 by tubular baffle 56. Burner 50 of this invention, like burner 62 of assignee's patent, is surrounded by metal liner 57 that has multiple louvers 58. Liner 57 spaced from combustion surface 54 serves to confine the combustion zone.

Housing 59 is a metal cylinder attached to the casing of a gas turbine (not shown). Three-segment burner 50 is attached to housing cap 63 by spacer bolts (not shown). Inasmuch as prior burner 62 was made with a dual porosity burner face 64, the new three-segment burner 50 can also have burner face 54 with dual porosity. The tapered cylindrical support of burner face 54 has an impervious cylindrical extension 54A welded to a circular opening in metal disk 60. Similarly, baffle 56 is welded to an opening in disk 61 and baffle 55 is connected to an opening in disk 62. Spacer bolts (not shown) hold disks 60, 61, 62 in the desired spaced arrangement and spacer bolts between disk 62 and housing cap 63 support the entire assembly of disks 60, 61, 62 which are components of burner 50. Cylindrical band 65 is welded to disk 60 and is dimensioned for a slip-fit with collar 64 of liner 57. Thus, when cap 63 is lifted away from housing 59, all of burner 50 is withdrawn from housing 59.

Plenums 51, 52, 53 are each supplied with fuel gas by valved tubes 66, 67, 68, respectively. Pipe 69 feeds tubes 66, 67, 68 which are connected to ring manifolds 70, 71, 72, respectively, each manifold having multiple holes positioned to inject fuel gas above disks 62, 61, 60, respectively. Compressed air from the compressor section of a gas turbine (not shown) flows into and fills housing 59 which is part of the casing of the turbine. Compressed air in housing 59 flows over disks 60, 61, 62 and into plenums 53, 52, 51, respectively. Compressed air discharges from plenums 51, 52, 53 through segments A, B, C, respectively, of porous fiber burner face 54 into combustion zone 75. Compressed air also passes through the multiple louvers 58 of liner 57 into combustion zone 75. By opening the valve of tube 68, fuel gas is injected upward as multiple jets from holes in ring manifold 72 into the compressed air flowing over disk 60 and the resulting gas-air mixture flows into plenum 53 from which it exits through segment C of porous burner face 54 and, upon ignition, undergoes radiant surface combustion. Any known igniter 76 positioned below disk 60 near segment C will ignite the gas-air mixture exiting segment C of porous burner face 54.

When greater thermal delivery is required, fuel gas may similarly be fed through valved tube 67 to ring manifold 71, and injected by manifold 71 as multiple jets into compressed air flowing between disks 61, 62. Thence, the mixture flows through plenum 52 and segment B of burner face 54 to produce more surface-stabilized combustion. For maximum heating, fuel gas is admitted through valved tube 66 to manifold 70 from which it escapes as multiple jets into compressed air passing between disks 62 and housing cap 63. The gas-air mixture fills plenum 51 and combusts upon exiting segment A of porous burner face 54. The products of combustion from segments A, B, C mix with compressed air entering combustion zone 75 through louvers 58 of liner 57. The total hot gases flow from combustion zone 75 through curved duct 77 (partially shown) which channels the hot gases to the turbine (not shown) as the driving force thereof.

The great range of thermal modulation made possible by the invention is best appreciated if the area of combustion surface 54 of segmented burner 50 and the area of combustion surface 64 of prior burner 62 (U.S. Pat. No. 6,199,364) are made equal. Burner 62 can be thermally modulated over a range that is characteristic for the selected type of combustion surface. If the same type of combustion surface is used on segmented burner 50, then all three segments A, B, C can be individually and independently modulated to the same extent as combustion surface 64 of prior burner 62. But segmented burner 50 can have any one or two of segments A, B, C turned off by closing valved tubes 66, 67, 68, respectively, to achieve a great turn-down of heat output to a small fraction of the lowest turn-down possible with prior burner 62.

A two-segment burner that still permits substantially broader thermal modulation than prior burner 62 can be visualized by eliminating either tubular baffle 55 along with disk 62, ring manifold 70 and valved tube 66, or tubular baffle 56 along with disk 61, manifold 71 and valved tube 67. Segmented burner 50 is shown in FIG. 6 in a preferred cone-like shape, i.e., a conical form with a convex end in lieu of a pointed apex. This term, cone-like shape, as herein used, shall also include truncated conical forms. Of course, other forms of segmented burners, such as those shown in FIGS. 1, 2, 4, 5 may be adapted for use with gas turbines.

The unique feature of segmented burners of this invention for gas turbines is that compressed air from the compressor of a gas turbine flows into and around the segmented burner continuously whether one or all the segments are being fed fuel gas. The percentage of compressed air going into each segment and around the burner being fixed by the dimensions given the various parts of the burner. For example, if the space between disks 61, 62 is reduced, less compressed air will flow into plenum 52. In short, while a burner is in operation, at any rate of compressed air flow, the flow of compressed air into any plenum cannot be varied. Only the flow of fuel gas can be varied to each plenum.

Figure 7:
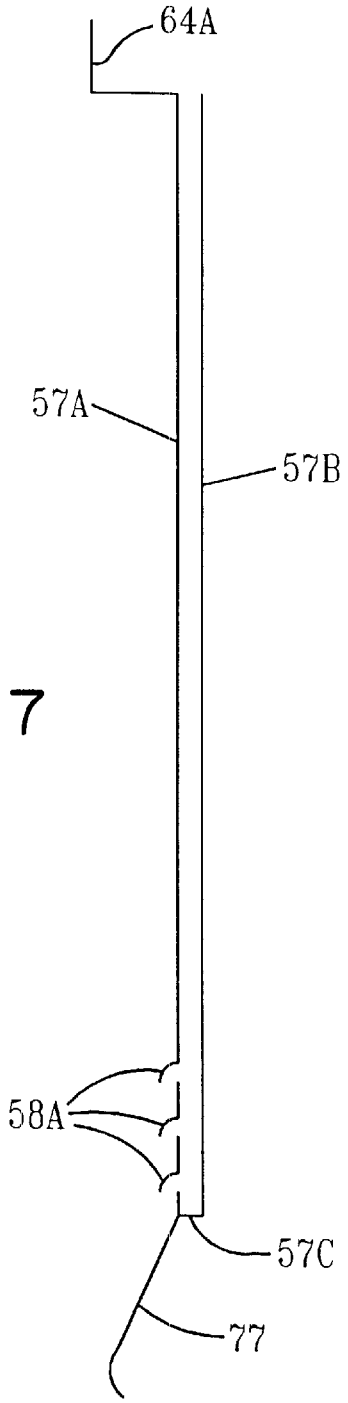
FIG. 7 shows an alternate form of an element of the burner of FIG. 6.

While burner 50 is shown in FIG. 6 with a louvered liner 57, an alternate liner is known as a backside-cooled liner (ASME Paper 99—GT-239). FIG. 7 is a schematic representation of backside-cooled liner 57A as a substitute for louvered liner 57 of FIG. 6. FIG. 7 shows only the right profile of liner 57A inasmuch as the left profile is only a mirror image of FIG. 7. Liner 57A is without louvers or other openings except for a few louvers 58A in the end portion of liner 57A which is connected to curved duct 77. A cylindrical metal shell 57B, called convector in the ASME Paper, surrounds liner 57A and is spaced therefrom to provide a narrow annular gap. Convector 57B extends over substantially the full length of liner 57A and is connected and sealed to liner 57A at 57C where liner 57A meets curved duct 77.

Thus, compressed air flowing between housing 59 and convector 57B will, besides entering the spaces between disks 60, 61, 62 and housing cap 63, flow through the gap between convector 57B and liner 57A exiting through a few rows of openings or louvers 58A in the portion of liner 57A adjacent to curved duct 77. Accordingly, any liner that serves to confine the combustion zone close to the burner surface and to moderate the combustion temperature can be used with the segmented burner.

Moreover, each burner need not have an individual liner. U.S. Pat. No. 6,199,364 shows a circular array of five burners in FIG. 3 which have a pair of metal liners that confine the combustion of all five burners in an annular zone. Such a collective liner may be used for several burners of this invention. Inasmuch as the collective liner is in two concentric parts, it is possible to cool each part with compressed air in a different way. For example, the inner liner may be louvered and the outer liner may be backside-cooled, or vice versa.

As known, the metal screen which supports the porous fiber layer of surface combustion burners usually has a perforated back-up plate that helps to ensure uniform flow of the fuel gas-air mixture though all of the porous fiber burner face. In a unitary (not modular) segmented burner of this invention, each internal baffle can be held in place by welding to a back-up plate. In the absence of a back-up plate, a baffle can be welded to the screen that supports the porous fiber layer.

While natural gas is a fuel commonly used with gas turbines, the burner of this invention may be fired with higher hydrocarbons, such as propane. Liquid fuels, such as alcohols and gasoline, may be used with the burner of the invention, if the liquid fuel is completely vaporized before it passes through the porous burner face. The term, gaseous fuel, has been used to include fuels that are normally gases as well as those that are liquid but completely vaporized prior to passage through the burner face. Another feature of the invention is that the burner is effective even with low BTU gases, such as landfill gas that often is only about 40% methane.

The term, excess air, has been used herein in its conventional way to mean the amount of air that is in excess of the stoichiometric requirement of the fuel with which it is mixed.

Those skilled in the art will visualize variations and modifications of the invention in light of the foregoing teachings without departing from the spirit or scope of the invention. For example, circular manifold 70 in FIG. 6 can be eliminated if valved fuel tube 66 is extended so that it discharges through a mixing nozzle into the opening where baffle 55 is joined to disk 62. Accordingly, only such limitations should be imposed on the invention as are set forth in the appended claims.

What is claimed is:

1. A segmented, radiant gas burner which comprises at least two plenums with fixed inlet openings to concurrent flow of air into all of said plenums, each of said plenums having a porous fiber burner face, and individual valved means for independently injecting fuel gas into each of said fixed openings, the porous fiber burner faces of all of said plenums forming a substantially continuous burner face.

2. The burner of claim 1 wherein each plenum and its porous fiber burner face is a module that can be removed from said burner.

3. The burner of claim 2 wherein the burner faces of the assembled modules form a substantially continuous burner face having a cone-like shape.

4. The burner of claim 1 wherein the fixed inlet opening of each plenum is surrounded by a flange, and the individual valved means for injecting fuel gas into said fixed opening comprises a circular perforated manifold juxtaposed with said flange.

5. The burner of claim 1 wherein the plenums are separated from one another by baffles that partition a unitary burner face.

6. The burner of claim 5 wherein the unitary burner face has a cone-like shape.

7. The burner of claim 6 wherein the fixed inlet opening of each plenum is surrounded by a flange, and the individual valved means for injecting fuel gas into said fixed opening comprises a circular, perforated manifold juxtaposed with said flange.

8. The burner of claim 1 wherein the burner face has dual porosities that, when fired at atmospheric pressure, can yield radiant surface combustion interspersed with blue flame combustion.

9. The burner of claim 1 which comprises a louvered metal liner or backside-cooled liner positioned to provide a compact combustion zone adjacent the burner face.

10. The burner of claim 3 wherein the burner face has dual porosities that, when fired at atmospheric pressure, can yield radiant surface combustion interspersed with blue flame combustion.

11. The burner of claim 4 wherein the burner face has dual porosities that, when fired at atmospheric pressure, can yield radiant surface combustion interspersed with blue flame combustion.

12. The burner of claim 6 wherein the burner face has dual porosities that, when fired at atmospheric pressure, can yield radiant surface combustion interspersed with blue flame combustion.

13. The burner of claim 7 wherein the burner face has dual porosities that, when fired at atmospheric pressure, can yield radiant surface combustion interspersed with blue flame combustion.

14. The burner of claim 3 which comprises a louvered metal liner or backside-cooled liner positioned to provide a compact combustion zone adjacent the burner face.

15. The burner of claim 4 which comprises a louvered metal liner or backside-cooled liner positioned to provide a compact combustion zone adjacent the burner face.

16. The burner of claim 6 which comprises a louvered metal liner or backside-cooled liner positioned to provide a compact combustion zone adjacent the burner face.

17. The burner of claim 7 which comprises a louvered metal liner or backside-cooled liner positioned to provide a compact combustion zone adjacent the burner face.

18. The burner of claim 13 which comprises a louvered metal liner or backside-cooled liner positioned to provide a compact combustion zone adjacent the burner face.

19. The burner of claim 12 wherein the burner segments have unequal heat delivery capacities.

* * * * *